US009093793B2

(12) United States Patent
Naito

(10) Patent No.: US 9,093,793 B2
(45) Date of Patent: Jul. 28, 2015

(54) ELECTRICAL CONNECTOR HAVING A CONDUCTIVE SHIELDING PLATE COVERING A LOCKING HOLE

(71) Applicant: Japan Aviation Electronics Industry, Limited, Tokyo (JP)

(72) Inventor: Takeharu Naito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 116 days.

(21) Appl. No.: 14/042,779

(22) Filed: Oct. 1, 2013

(65) Prior Publication Data

US 2014/0322956 A1 Oct. 30, 2014

(30) Foreign Application Priority Data

Apr. 25, 2013 (JP) ..... 2013-092437

(51) Int. Cl.
*H01R 13/648* (2006.01)
*H01R 13/6582* (2011.01)

(52) U.S. Cl.
CPC ..... *H01R 13/6582* (2013.01)

(58) Field of Classification Search
CPC ..... H01R 13/6275; H01R 13/6852
USPC ..... 439/370, 350, 607.17
See application file for complete search history.

(56) References Cited

U.S. PATENT DOCUMENTS

| | | | | |
|---|---|---|---|---|
| 6,234,827 | B1 * | 5/2001 | Nishio et al. | 439/357 |
| 2007/0082554 | A1 | 4/2007 | Saito | |
| 2008/0132116 | A1 * | 6/2008 | Wu | 439/609 |
| 2009/0023336 | A1 | 1/2009 | Kondo et al. | |
| 2010/0227504 | A1 * | 9/2010 | Wang et al. | 439/607.41 |
| 2012/0252255 | A1 * | 10/2012 | Colantuono et al. | 439/353 |
| 2014/0024260 | A1 * | 1/2014 | Dong et al. | 439/626 |

FOREIGN PATENT DOCUMENTS

JP 2007-103249 A 4/2007

* cited by examiner

*Primary Examiner* — Vanessa Girardi
(74) *Attorney, Agent, or Firm* — Collard & Roe, P.C.

(57) ABSTRACT

An electrical connector has a conductive shell provided with a locking hole adapted to be engaged with a mating object in a disconnection direction. An insulator is received inside the shell. Between the shell and the insulator, a conductive shielding plate covering the locking hole is provided so that the insulator is not visible through the locking hole. The insulator holds a conductive contact.

4 Claims, 8 Drawing Sheets

ELECTRICAL CONNECTOR HAVING A CONDUCTIVE SHIELDING PLATE COVERING A LOCKING HOLE

This application is based upon and claims the benefit of priority from Japanese Patent Application No. 2013-092437, filed Apr. 25, 2013, the disclosure of which is incorporated herein in its entirety by reference.

BACKGROUND OF THE INVENTION

1. Field of the Invention

This invention relates to an electrical connector and, in particular, to an electrical connector having a locking mechanism for locking a connected state.

2. Description of Related Art

As an example of an electrical connector of the type, a USB connector is known. In the USB connector also, high-speed signal transmission is required. In order to increase a transmission speed in the USB connector, it is necessary to improve EMI characteristics as disclosed in JP-A-2007-103249 (Patent Document 1). Herein, referring to FIGS. 1 and 2, the technique disclosed in Patent Document 1 will briefly be described.

Referring to FIG. 1 (a connector disclosed as a conventional example in Patent Document 1), a cable connector 1 has a shell 2 provided with a friction lock hole 3. On the other hand, a board connector 4 as a mating object has a shell 5 provided with spring members 6 and 7. When the cable connector 1 is connected to the board connector 4, a part of the spring member 6 is fitted to the friction lock hole 3 to thereby lock a connected state. However, the spring member 6 is not brought into contact with the shell 2. After the other spring member 7 is brought into contact with the shell 2, the shell 2 and the shell 5 are electrically connected to each other. As a result, improvement of EMI characteristics is expected.

Referring to FIG. 2 (a characteristic part of a connector disclosed as an invention in Patent Document 1), a cable connector 1 has a shell 2 provided with a friction lock groove 8 instead of the friction lock hole. The friction lock groove 8 is a recessed portion formed by utilizing a cut formed in the shell 2. The friction lock groove 8 has a bottom member 9 depressed inwards from a shell surface. When the cable connector 1 is connected to a board connector 4, a spring member 6 of the board connector 4 is fitted to the friction lock groove 8 to lock a connected state. Simultaneously, the spring member 6 is brought into contact with the bottom member 9. Therefore, improvement of EMI characteristics is expected.

The locking mechanism in which the spring member 6 is fitted to the locking hole 3 or the friction lock groove 8 as described above is called a friction locking mechanism.

SUMMARY OF THE INVENTION

However, in the structure shown in FIG. 1, a gap is left between the friction lock hole 3 and the spring member 6. Accordingly, electromagnetic shield is insufficient and, therefore, EMI characteristics are not good.

Further, in the structure shown in FIG. 2, the friction lock groove 8 is covered by the bottom member 9 and, therefore, a gap is smaller. However, occurrence of a slight gap is inevitable in manufacturing technique because the friction lock groove 8 is formed by utilizing a cut formed in the shell 2. Accordingly, EMI characteristics are not good.

It is therefore an exemplary object of the present invention to further improve EMI characteristics of an electrical connector having a friction locking mechanism.

Other Objects of the present invention will become clear as the description proceeds.

According to an exemplary aspect of the present invention, there is provided an electrical connector comprising a conductive shell provided with a locking hole adapted to be engaged with a mating object in a disconnection direction, an insulator received inside the shell, a conductive contact held in the insulator, and a conductive shielding plate located between the insulator and the shell and covering the locking hole, the shielding plate preventing the insulator from being visible through the locking hole.

DESCRIPTION OF THE EXEMPLARY EMBODIMENT

Figure 1:
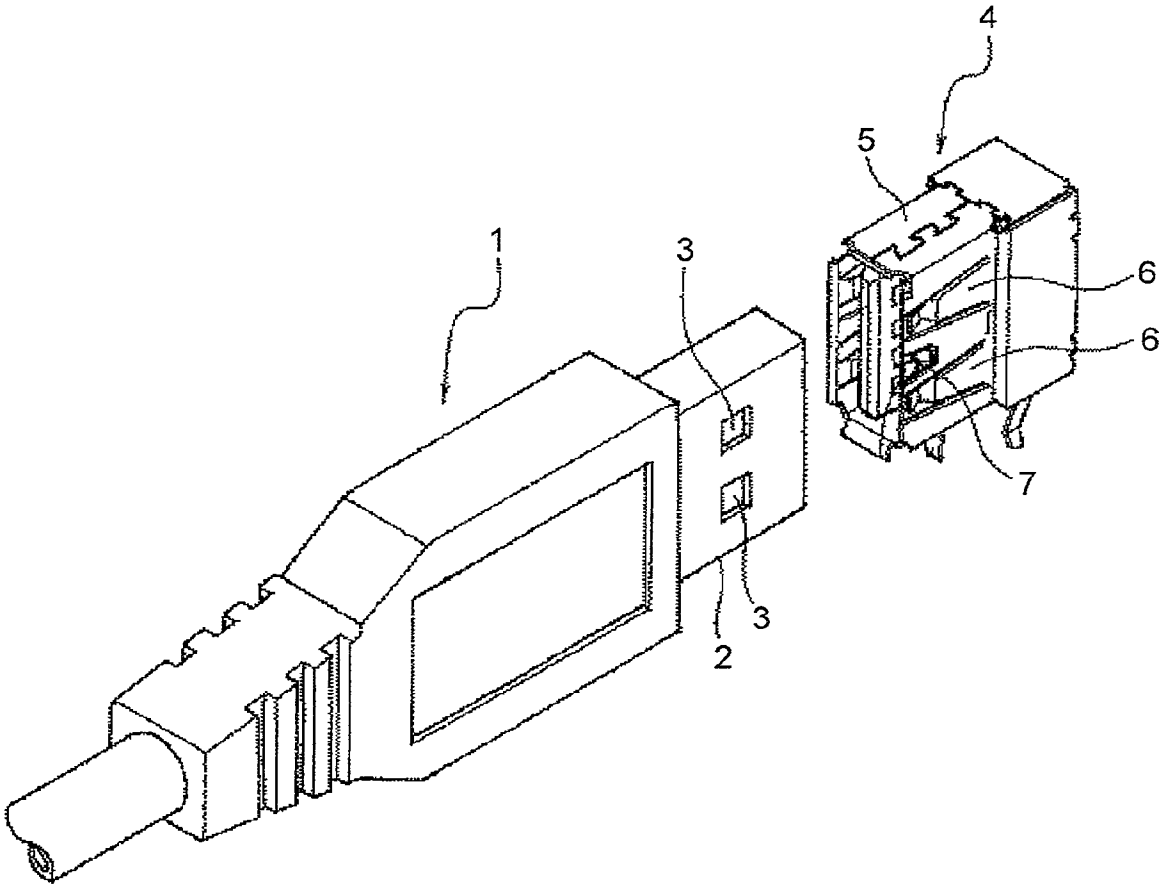
FIG. 1 PRIOR ART
FIG. 1 is a perspective view of a connector disclosed as a conventional example in Patent Document 1 (JP-A-2007-103249)
Figure 2:
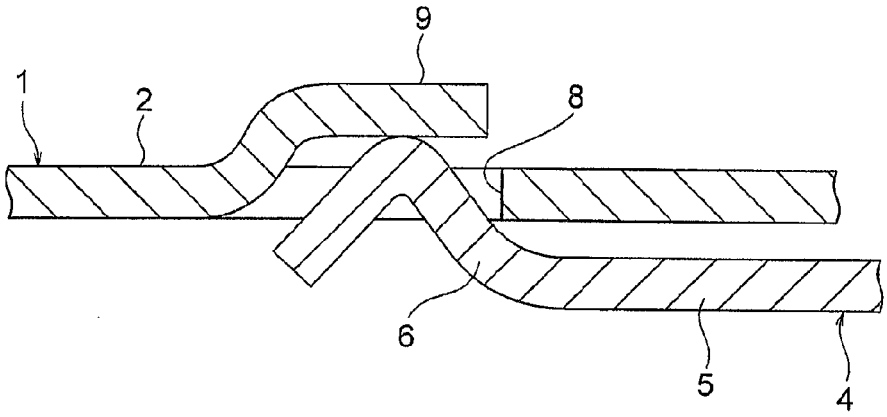
FIG. 2 PRIOR ART
FIG. 2 is a sectional view of only a characteristic part of another connector disclosed as an invention in Patent Document 1.
Figure 3:
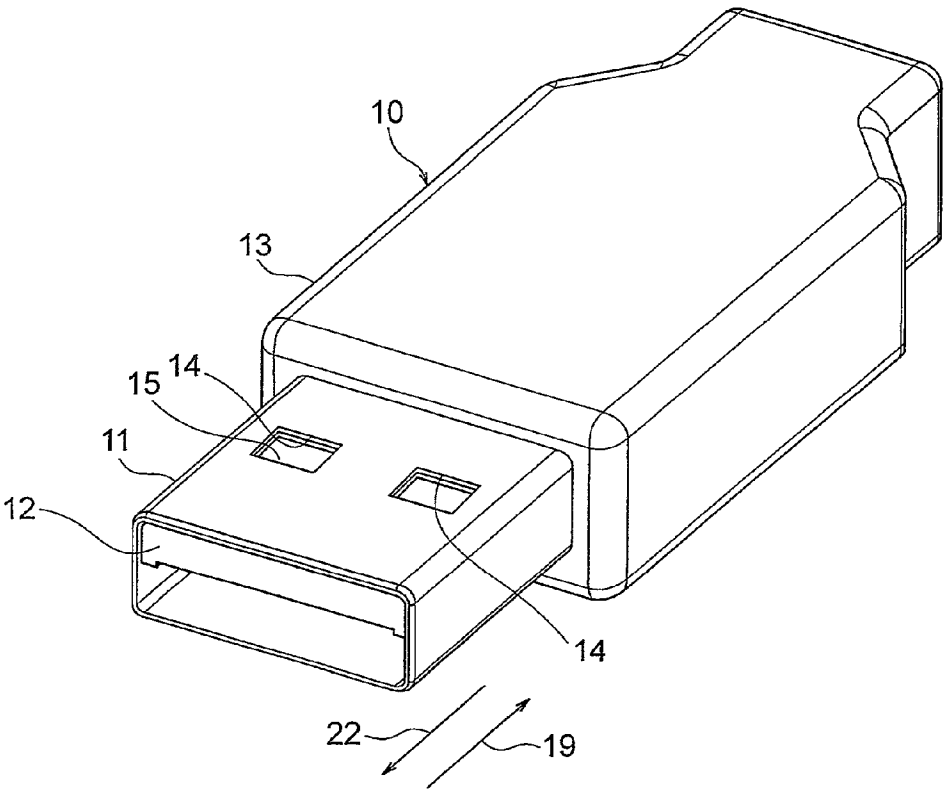
FIG. 3 is a perspective view of an electrical connector (USB plug connector) according to an exemplary embodiment of the present invention.
Figure 4:
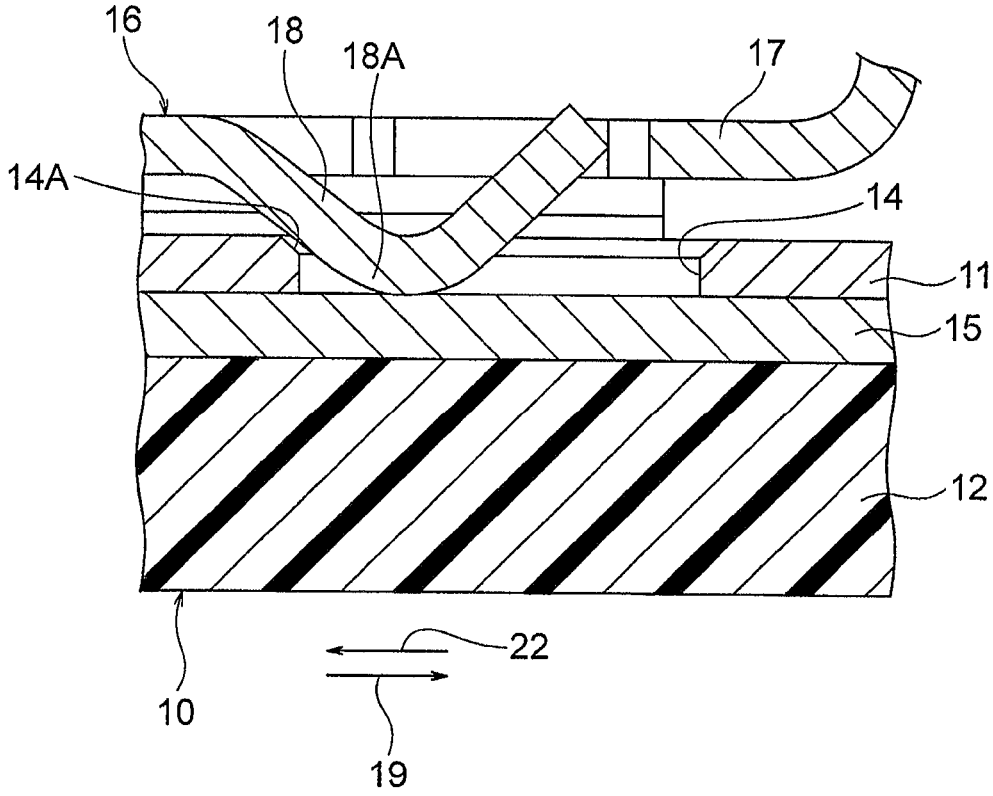
FIG. 4 is an enlarged sectional view of only a characteristic part showing a state where the electrical connector in FIG. 3 is connected to a mating object.

Referring to FIGS. 3 and 4, description will be made about a general structure of an electrical connector according to an exemplary embodiment of the present invention.

FIG. 3 shows a USB connector plug (hereinbelow, simply called "plug") 10 as an electrical connector. The plug 10 includes a conductive shell 11 and an insulator 12 received inside the shell 11. The shell 11 has a rear part covered by a resin hood 13 which is formed by insert molding. The shell 11 has a front part which is exposed to the outside without being covered by the resin hood 13 and which is provided with two locking holes 14.

Between the shell 11 and the insulator 12, a conductive shielding plate 15 for covering the locking holes 14 is arranged. As described above, by providing the shielding plate 15, the insulator 12 is not visible through the locking holes 14. The insulator 12 holds a conductive contact as will later become clear.

FIG. 4 shows only a characteristic part when the plug 10 is fitted to a USB receptacle connector (hereinbelow simply called "receptacle") 16 as a mating object. The receptacle 16 has a conductive shell 17 provided with two shell springs 18 integrally formed therewith.

When the plug 10 is fitted to the receptacle 16, a part 18A of each of the shell springs 18 is inserted down into the locking hole 14 and engaged with an edge 14A of the locking hole 14 in a disconnection direction 19. As a result, the plug 10 is locked to the receptacle 16 by so-called friction lock.

Thus, a friction locking mechanism is provided. Simultaneously, the part 18A of the shell spring 18 is brought into contact with the shielding plate 15. As a result, the shielding plate 15 is electrically connected to the shell 17 of the receptacle 16 through the shell spring 18. The shielding plate 15 covers the locking holes 14 so that the insulator 12 is not visible through the locking holes 14. Therefore, it is possible to further improve EMI characteristics.

In the plug 10 described above, EMI characteristics are further improved although the friction locking mechanism is provided.

Referring to FIGS. 5 to 8, a manufacturing process of the plug 10 will be described.

Figure 6:
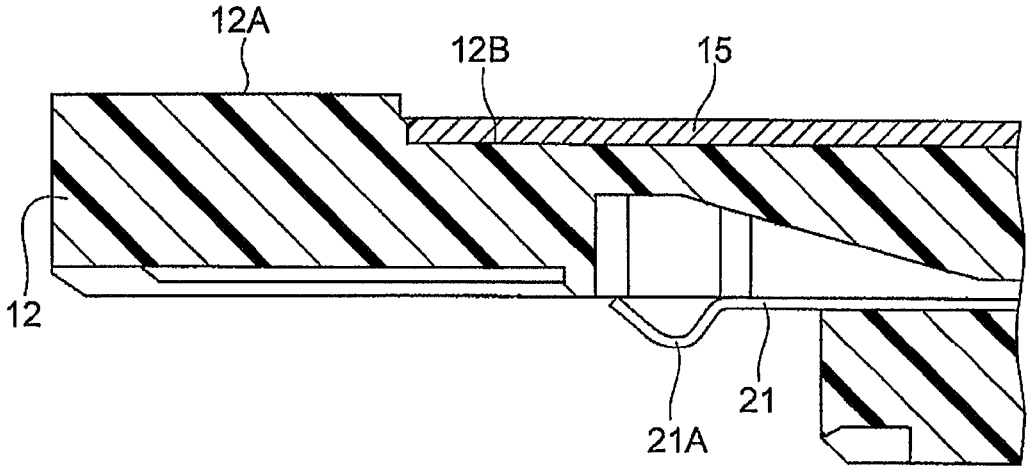
FIG. 6 is an enlarged sectional view of only a characteristic part, taken along a line VI-VI in FIG. 5.

As shown in FIG. 6, the insulator 12 fixedly holding the conductive contact 21 is prepared. The contact 21 has a contacting portion 21A formed at a front part thereof. The contacting portion 21A is exposed on a lower surface of the insulator 12. At a relatively front part of an upper surface of the insulator 12, a recess 12B recessed with respect to a main surface 12A is formed so as not to be visible from a connection direction 22.

Figure 5:
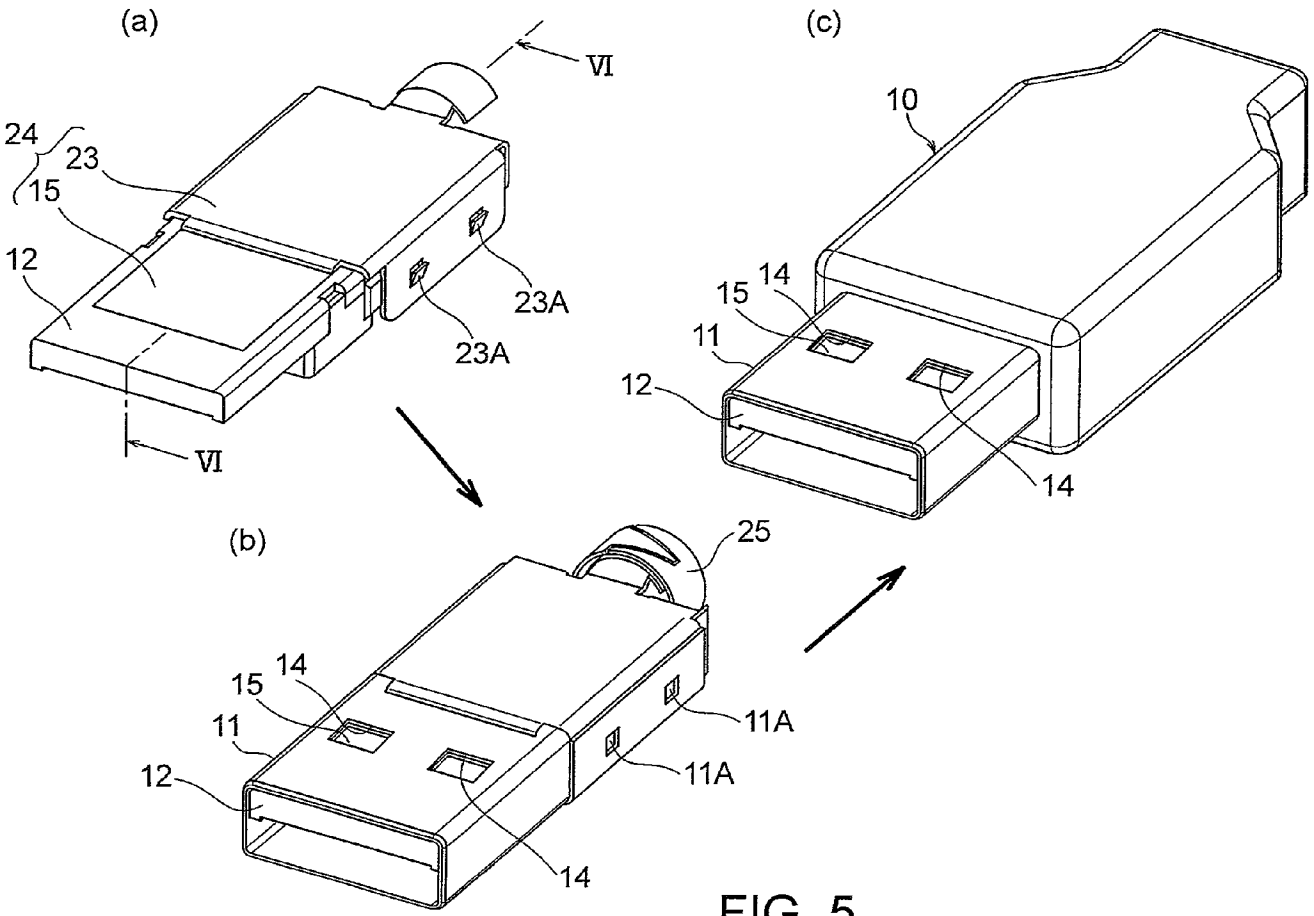
FIG. 5 is a perspective view for describing a manufacturing process of the electrical connector in FIG. 3.

As shown in FIG. 5(*a*) and FIG. 6, a conductive member 24 is mounted to the insulator 12 from an upper side. The conductive member 24 comprises the shielding plate 15 and a shielding member 23, which are integrally formed. At this time, the shielding plate 15 is arranged inside the recess 12B at the relatively front part of the insulator 12 while the shielding member 23 is arranged at a relatively rear part of the insulator 12. Herein, a depth of the recess 12B and a thickness of the shielding plate 15 are designed so that a surface of the shielding plate 15 is even or flush with or located inside the main surface 12A of the insulator 12. The shielding member 23 has claws 23A formed on side surfaces thereof.

Next, as shown in FIG. 5(*b*), the shell 11 is mounted to the insulator 12 from a front side and the claws 23A are engaged with engaging holes 11A of the shell 11, respectively.

Figure 7A:
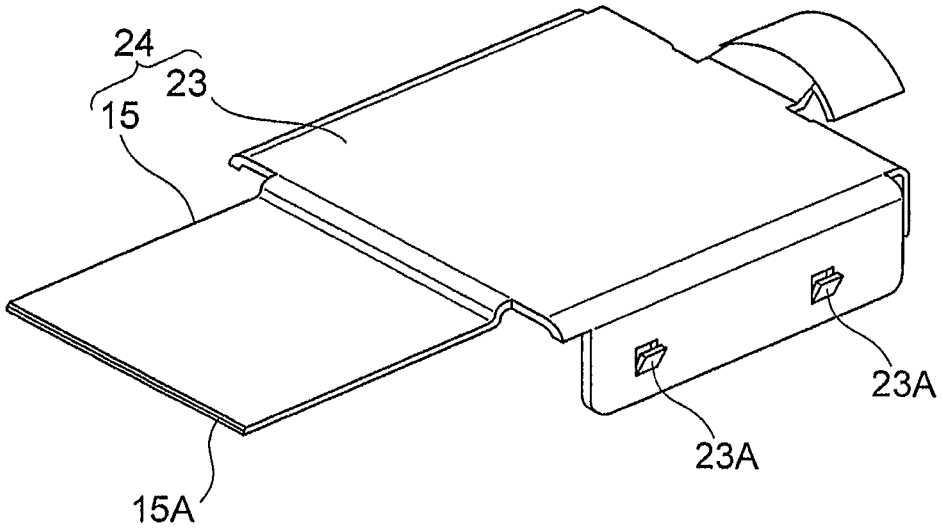
FIG. 7A is a perspective view of a component included in the electrical connector in FIG. 3.
Figure 7B:
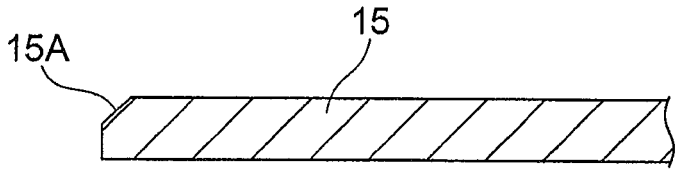
FIG. 7B is an enlarged sectional view of only a characteristic part of the component shown in FIG. 7A.

As shown in FIGS. 7A and 7B, the shielding plate 15 is provided with a chamfer 15A formed on its end face on a side opposite to the shielding member 23. With this structure, it is possible to facilitate a mounting operation of the shell 11.

As described above, the conductive member 24 and the shell 11 are mounted to and fixed to the insulator 12. In this state, the shell 11 is brought into contact with the main surface 12A of the insulator 12. Therefore, the main surface 12A may be called a shell-contacting surface. It is noted here that, at a rear end portion 25 which holds a cable (not shown) and locks such holding state, the shell 11 and the shielding plate 15 are brought into contact with each other to be electrically reliably connected to each other.

Next, as shown in FIG. 5(*c*), the resin hood 13 is insert-molded and then the plug 10 is completed.

In the plug 10 described above, the shielding plate 15 is integrally formed with the shielding member 23 inside the resin hood 13 and covers the locking holes 14 inside the shell 11 without leaving a gap. Accordingly, electromagnetic shielding effect is increased and, consequently, EMI characteristics are improved.

Especially, a design tolerance taking a manufacturing tolerance into account is set so that the surface of the shielding plate 15 is assured to be located inside the main surface 12A of the insulator 12 to thereby prevent a gap being formed between the shell 11 and the insulator 12. Therefore, the plug 10 is fitted to the receptacle 16 without occurrence of interference which is a cause of breakage.

Further, the surface of the shielding plate 15 is designed to be located inside the main surface 12A of the insulator 12 and the amount of displacement of the shell spring 18 of the friction locking mechanism is designed so that the shell spring 18 is reliably brought into contact with the surface of the shielding plate 15 when the plug is fitted to the receptacle. With this structure, the shell spring 18 is more deeply engaged with the locking hole 14. Therefore, it is possible to obtain the electromagnetic shielding effect of the locking hole 14 and an additional effect that a locking force of the friction locking mechanism is increased.

Figure 8:
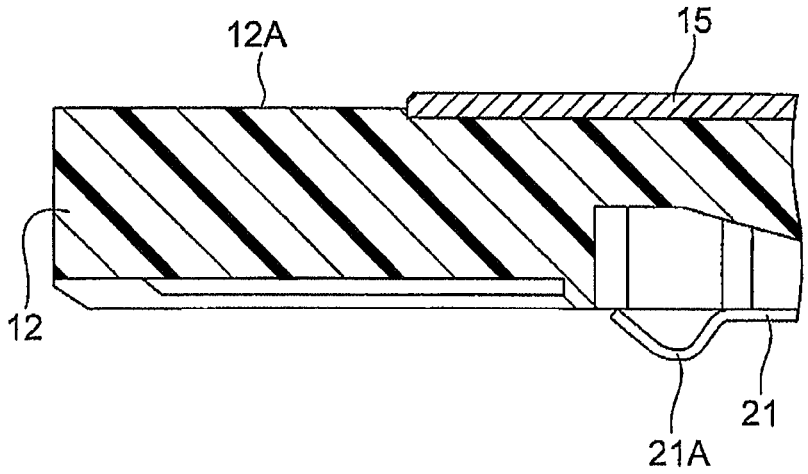
FIG. 8 is a sectional view of only a characteristic part for describing a modification.

Although the description has been made using the exemplary embodiment, the surface of the shielding plate 15 may be higher than the main surface 12A of the insulator 12 as shown in FIG. 8.

A part or the whole of this invention can also be described as the following supplementary notes but is not limited thereto.

(Supplementary Note 1). An electrical connector comprising:

a conductive shell 11 provided with a locking hole 14 adapted to be engaged with a mating object 16 in a disconnection direction 19;

an insulator 12 received inside the shell 11;

a conductive contact 21 held in the insulator 12; and a conductive shielding plate 15 located between the insulator 12 and the shell 11 and covering the locking hole 14;

the shielding plate 15 preventing the insulator 12 from being visible through the locking hole 14.

(Supplementary Note 2). The electrical connector according to claim 1, further comprising a conductive shielding member 23 arranged at a relatively rear part of the electrical connector; the locking hole 14 being positioned at a relatively front part of the electrical connector; the shielding plate 15 being formed integrally with the shielding member 23.

(Supplementary Note 3). The electrical connector according to claim 1 or 2, wherein the insulator 12 is provided with a recess 12B which is not visible from a connection direction 22; the shielding plate 15 being arranged inside the recess 12B; the shielding plate 15 having a surface located inside a shell-contacting surface 12A of the insulator 12, which is brought into contact with the shell 11.

While the invention has been particularly shown and described with reference to exemplary embodiment, the invention is not limited to the embodiment. It will be understood by those of ordinary skill in the art that various changes in form and details may be made therein without departing from the spirit and scope of the present invention as defined by the claims.

What is claimed is:

1. An electrical connector comprising:

a conductive shell provided with a locking hole adapted to be engaged with a mating object in a disconnection direction;

an insulator received inside the shell;

a conductive contact held in the insulator; and a conductive shielding plate located between the insulator and the shell and covering the locking hole;

the shielding plate preventing the insulator from being visible through the locking hole.

2. The electrical connector according to claim 1, wherein the insulator is provided with a recess which is not visible from a connection direction; the shielding plate being arranged inside the recess; the shielding plate having a surface located inside a shell-contacting surface of the insulator, which is brought into contact with the shell.

3. The electrical connector according to claim 1, further comprising a conductive shielding member arranged at a relatively rear part of the electrical connector; the locking hole being positioned at a relatively front part of the electrical connector; the shielding plate being formed integrally with the shielding member.

4. The electrical connector according to claim 3, wherein the insulator is provided with a recess which is not visible from a connection direction; the shielding plate being arranged inside the recess; the shielding plate having a surface located inside a shell-contacting surface of the insulator, which is brought into contact with the shell.

* * * * *